US007048407B2

(12) United States Patent
Kumthampinij et al.

(10) Patent No.: US 7,048,407 B2
(45) Date of Patent: May 23, 2006

(54) MINIATURE LED FLASHLIGHT

(75) Inventors: Yos Kumthampinij, Jersey City, NJ (US); Kenneth Zorovich, Hoboken, NJ (US)

(73) Assignee: Princeton Tectonics, Inc., Bordentown, NJ (US)

( * ) Notice: Subject to any disclaimer, the term of this patent is extended or adjusted under 35 U.S.C. 154(b) by 410 days.

(21) Appl. No.: 10/679,656

(22) Filed: Oct. 6, 2003

(65) Prior Publication Data

US 2005/0030740 A1 Feb. 10, 2005

Related U.S. Application Data

(60) Provisional application No. 60/493,306, filed on Aug. 7, 2003.

(51) Int. Cl.
*F21L 4/04* (2006.01)

(52) U.S. Cl. ..... 362/200; 362/191; 362/196; 362/656; 362/800; 362/116

(58) Field of Classification Search ..... 362/200, 362/190, 191, 196, 656, 655, 368, 396, 800, 362/157, 116; 70/456 R, 459, 456 B, 460; D3/209, 207, 208; 206/38.1, 37, 37.1, 38, 206/37.4, 37.5; 24/3.1, 3.12, 3.11, 3.6, 598.1, 24/598.2, 599.1

See application file for complete search history.

(56) References Cited

U.S. PATENT DOCUMENTS 1,678,016 A * 7/1928 Menke ..... 24/3.6
5,209,090 A * 5/1993 Stillwagon ..... 70/456 R
5,318,177 A * 6/1994 Isacson ..... 206/38.1

* cited by examiner

*Primary Examiner*—Sandra O'Shea
*Assistant Examiner*—Sharon Payne
(74) *Attorney, Agent, or Firm*—Howson and Howson

(57) ABSTRACT

A miniature LED flashlight is composed of a flashlight assembly and an attachment loop. The attachment loop is configured to require a two-step manipulation for attachment or detachment from a key ring. The flashlight assembly and attachment loop are attached by a snap fit relationship between a projection on one and a recess on the other, and can be readily disconnected by application of a bending force.

8 Claims, 3 Drawing Sheets

MINIATURE LED FLASHLIGHT

CROSS REFERENCE TO RELATED APPLICATION

This application claims the benefit of provisional application No. 60/493,306, filed Aug. 7, 2003.

FIELD OF THE INVENTION

This invention relates to flashlights, and more particularly to an improved miniature LED flashlight suitable for attachment to a keychain or the like.

BACKGROUND OF THE INVENTION

Keychain flashlights have been known for a long time, and became increasingly popular with the introduction of high-efficiency light emitting diode (LED) bulbs. LED bulbs can be powered by one or more "coin" cells, and can emit a high intensity beam of light. Depending on the particular LED used, an LED keychain flashlight can emit light in any of a variety of colors, such as white, red, blue and green.

These miniature flashlights are typically designed so that they can be removably attached to a key ring. Some have a case containing the power source, the LED and a switch, and a chain connecting the case to a snap hook which can removably receive a key ring. Others have one element of the snap hook formed as an integral part of the case, and the other element of the snap hook hinged to the case and urged toward a closed position by a spring, so that the combination takes the form of a so-called "carabiner" ring, which can be opened readily for removal from, or attachment to, a key ring.

The carabiner type key ring LED flashlight obviates the chain used in some keychain flashlights to connect the snap hook to the case. However, the carabiner type key ring flashlight is somewhat less flexible than the chain type. Thus, in using a carabiner type key ring flashlight to illuminate a door lock at night, it is often necessary to remove the flashlight from the key ring, since often the key cannot be inserted into the lock while the light is directed at the lock. The carabiner type flashlight can be readily removed from the key ring, but in order to make easy removal in the dark possible, the structure of the carabiner type snap hook is necessarily somewhat bulky, making the overall size of the flashlight structure large and unwieldy. Moreover, the assembly of the carabiner type device is somewhat difficult because it entails the installation of a spring needed to urge the movable element of the snap hook toward its closed condition.

SUMMARY OF THE INVENTION

The miniature flashlight in accordance with the invention comprises a case, a light emitting diode mounted in the case, an electrical power source also mounted in the case, a manually operable switching device for controlling delivery of electrical power from the source to the light emitting diode, and a mounting clip for attachment of the flashlight to a separate article. Either the case or the mounting clip has a recess, and the other part has a projection fitting the recess with a snap fit. Thus, the case can be rapidly removed from the mounting clip by manipulation for separation of the case from the mounting clip without disengagement of the mounting clip from the separate article.

In a preferred embodiment, the mounting clip has a base, and a loop a part of which is constituted by the base. The recess is formed in the base, and the projection is a part of the case.

The mounting clip may comprise a molded element having a resilient gate, the gate and a part of the molded element forming a loop openable to receive a key ring, and closable to maintain engagement of the loop with the key ring. The mounting clip can also be a unitary, molded, element, having a loop openable to receive a key ring, and closable to maintain engagement of the loop with the key ring.

The projection preferably has a main body and a pair of flanges, said flanges being disposed on opposite sides of the main body, and the recess has opposed interior side walls and retaining tabs formed on the side walls and engageable respectively with the flanges so that the projection fits the recess with a snap fit. The side walls of the recess are preferably resilient to allow the flanges of the projection to move past the retaining tabs when the case is removed from, and connected to, the mounting clip.

The flanges have rounded edges extending in the direction of elongation of the main body of the projection, so that the projection can be disengaged from the recess by a bending force exerted on the case and the mounting clip about a bend axis extending in the direction of elongation of the projection. Preferably the bending force is substantially less than the force required to remove the projection from the recess along the direction in which the projection extends from said case.

This invention provides a simple and elegant solution to the problem of temporarily removing a miniature flashlight from a keyring or other article to which it is normally attached. The user can readily separate the flashlight from its mounting clip without fumbling with a snap hook in the dark. Yet, the flashlight otherwise remains securely engaged with the mounting clip.

Other objects, details and advantages of the invention will be apparent from the following detailed description when read in conjunction with the drawings.

BRIEF DESCRIPTION OF THE DRAWINGS

FIG. 14 is an end elevational of the loop base, showing the recess therein.

DETAILED DESCRIPTION OF THE PREFERRED EMBODIMENT

As seen in FIGS. 1–6, the miniature flashlight is composed of two principal parts, a flashlight assembly 20, and an attachment loop 22.

Figure 2:
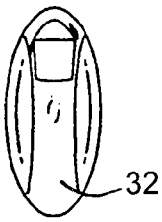
FIG. 2 is a left side elevational view thereof.
Figure 1:
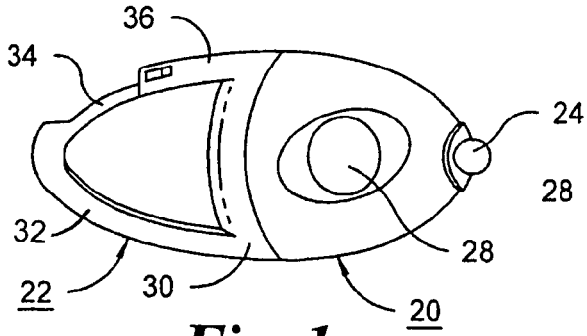
FIG. 1 is a front elevational view of a miniature LED flashlight in accordance with the invention.
Figure 3:
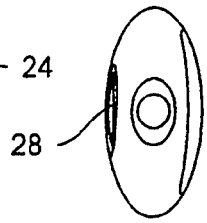
FIG. 3 is a right side elevational view thereof.
Figure 4:
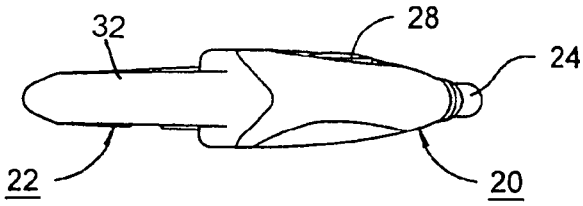
FIG. 4 is a bottom plan view thereof
Figure 5:
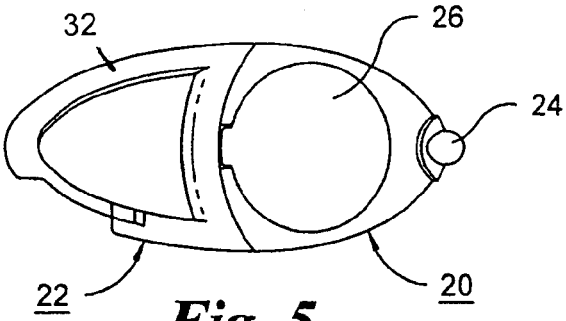
FIG. 5 is a rear elevational view thereof.
Figure 6:
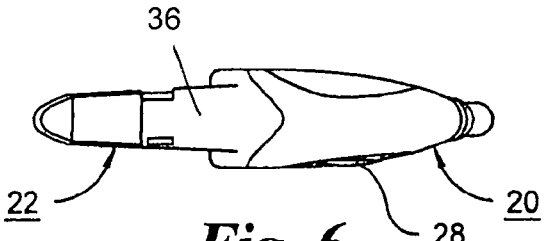
FIG. 6 is a top plan view thereof.

The flashlight assembly includes a high intensity light-emitting diode (LED) device 24, which includes a lens for focusing light emitted by the LED into a narrow beam directed along the direction of elongation of the flashlight assembly as seen in FIGS. 1, and 4–6. On the rear of the flashlight assembly 20, as shown in FIG. 5, a removable cover 26 encloses an interior space for receiving a power supply, preferably consisting of a pair of coin cells (not shown). A push-button 28, seen in FIGS. 1, 3, 4, and 6, is used to control an electrical switch (not shown) provided inside the flashlight assembly. The switch can be a simple momentary two-contact switch connected directly to the LED and the power supply so that the LED can be turned on while the button 28 is depressed and is otherwise turned off. Preferably, however, the push-button 28 controls a circuit of the kind described in U.S. Pat. No. 6,249,089, granted on Jun. 19, 2001, to effect more complex operations such as selection from among several illumination levels, selection of one or more flashing modes, and automatic turn-off.

The attachment loop 22 is preferably a unitary molded element comprising a base 30, a relatively thick first part 32, which extends rearward from one end of the base, a narrower second part 34, which extends forward from the rearmost part of part 32, and a relatively thick third part 36, which extends rearward from the opposite end of the base 30, meeting part 34 at an intermediate location.

Figure 9:
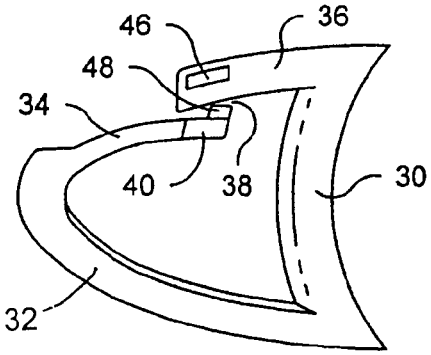
FIG. 9 is an elevational view of a mounting clip showing the loop in its opened condition.

Parts 34 and 36 are normally in engagement with each other so that the loop is closed, but are disengageable, part 34 serving as a gate to allow the loop to be attached to, or removed from, a key ring, or other article. The loop can be molded can be any resilient plastics material, and the narrow part 34 is more flexible than the other parts, allowing it to be pushed inward manually, as depicted in FIG. 9, so that it separates from part 36, leaving an opening at 38.

Figure 10:
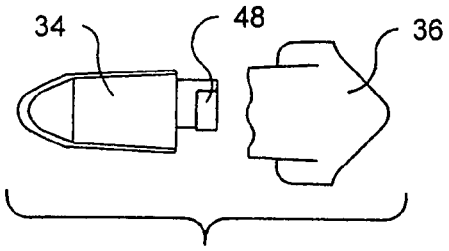
FIG. 10 is a partly broken-away top plan view of the structure of FIG. 9.
Figure 11:
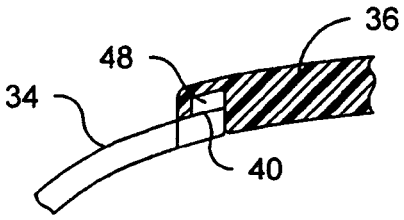
FIG. 11 is a fragmentary sectional view illustrating the closure of the loop.
Figure 12:
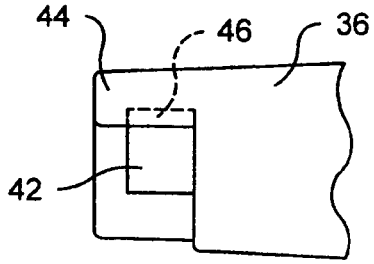
FIG. 12 is a fragmentary view, from inside the loop, showing one part of the loop disengaged from the other part.
Figure 13:
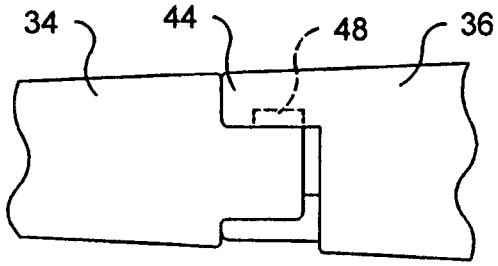
FIG. 13 is a fragmentary view, from inside the loop, showing the parts of the loop in their engaged condition.

As shown in FIG. 11, a projection 40 at the end of part 34 enters a recess formed in part 36, the recess 42, being shown in FIG. 12. Element 44, which is an integral part of part 36, has an opening 46 (see also FIG. 9), which is positioned as an extension of recess 42. This opening receives an overhanging part 48 (FIG. 10) of projection 40, when the resilient part 34 is relaxed. Thus, two movements are required to separate parts 34 and 36: a sideward movement of part 34 to release the overhanging part 48 from opening 46, and then an inward movement of part 34 to release projection 40 from the recess 42. Accordingly, the loop is resistant to inadvertent opening as a result of a force exerted in a single direction, and requires a relatively complex manipulation in order to be opened.

Figure 7:
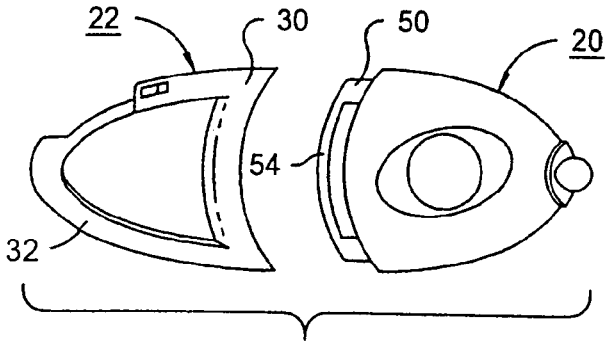
FIG. 7 is an exploded front elevational view showing the case of the flashlight removed from the mounting clip.
Figure 8:
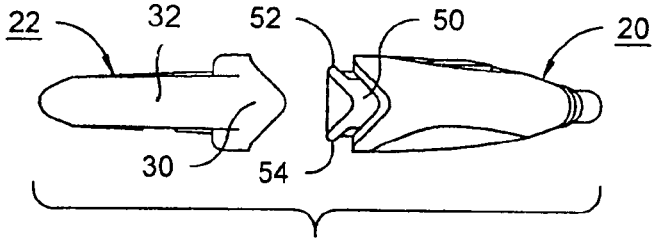
FIG. 8 is an bottom plan view of the exploded flashlight as shown in FIG. 7.

The flashlight assembly 20 and the attachment loop 22 are separable from each other as shown in FIGS. 7 and 8.

Figure 15:
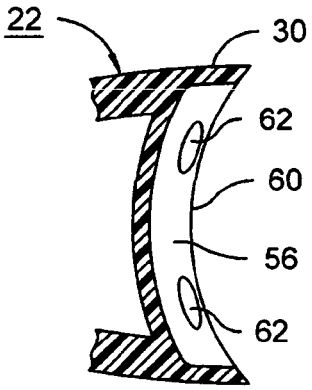
FIG. 15 is a fragmentary sectional view of the base of the loop, showing the recess therein, taken on plane 15—15 in FIG. 14.
Figure 14:
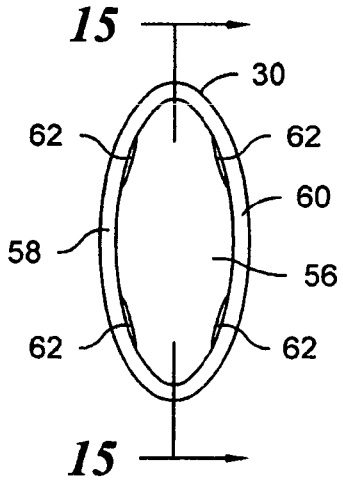
FIG. 14 is a fragmentary sectional view of the base of the loop, showing the recess therein.

As seen in FIGS. 7 and 8, an elongated projection 50 is provided on the rear of the flashlight assembly 20. This projection 50 is preferably a molded part of the flashlight body. The projection has a pair of upper and lower, rounded flanges 52 and 54, and is receivable in a recess 56 formed in the base 30 of the attachment loop 22, the recess 56 being shown in FIGS. 14 and 15. Inside the recess 56, extending inward from the opposite walls 58 and 60, are tabs 62, which are positioned to engage the flanges 52 and 54, to hold the flashlight assembly 20 and the attachment loop firmly together. The walls 58 and 60 of the loop base are resilient, allowing the flanges of the projection 50 to move past the tabs 62 so that the projection 50 can snap into place in the recess 56.

The projection 50 can be readily pushed straight into the recess 56 and snapped into place. However, when the projection 50 is in the recess, the tabs 62 and the flanges 52 and 54 are preferably sufficiently large that the flashlight assembly cannot be readily removed from the attachment loop by pulling the flashlight assembly in a straight direction so that both of the flanges 52 and 54 move past the tabs 62 at the same time. On the other hand, bending the flashlight assembly and attachment loop relative to each other about an axis extending generally in the direction of elongation of the projection 50, provides leverage which readily deforms the side walls of the recess 60 in the loop base, allowing the flashlight assembly to be easily separated from the attachment loop.

A significant advantage realized in the preferred embodiment of the invention just described is that the case is securely retained by the clip and cannot be easily removed by pulling it directly away from the clip, but can be easily removed with one hand by exerting a bending force between the clip and the case. The bending force will not ordinarily be encountered accidentally when the flashlight assembly is carried on a key ring, and accordingly unintentional loss of the flashlight is not likely to occur.

Various modifications can be made to the miniature flashlight according to the invention.

For example, the structure by which the flashlight assembly and attachment loop snap together can be realized in an embodiment in which a projection corresponding to projection 50 is disposed on the loop base and the recess corresponding to recess 56 is formed in the flashlight assembly. However, the embodiment described is preferable as the projection on the flashlight assembly allows a larger amount of internal space for electronic and other flashlight components.

In another modification, tabs corresponding to tabs 62 can be provided on the projection and flanges corresponding to flanges 52 and 54 can be provided in the recess. Alternatively, flanges or tabs can be provide on both the projection and the recess.

In still another modification, instead of a resilient narrow part 34 forming a gate of the loop, a gate can be provided by a generally U-shaped length of spring wire having its ends bent inwardly toward each other, the ends being disposed in offset holes in a part of the loop structure. The bent ends of the spring may also be offset from each other. The offset relationship of the holes is different from the offset relationship of the bent ends of the spring wire when the spring wire is relaxed. Consequently, when the ends of the spring wire are in the holes, the spring wire is under stress, causing the part of the spring wire remote from the ends to be urged toward a part of the loop, thereby normally maintaining the spring wire gate in a closed condition.

The mounting clip, although shown in the form of a loop adapted to be attached to a key chain or the like, can be provided in other configurations. For example, the mounting clip can be in the form of a spring clamp suitable for attachment to a belt or to the fabric of an article of clothing.

Still other modifications may be made to the apparatus and method described above without departing from the scope of the invention as defined in the following claims.

The invention claimed is:

1. A miniature flashlight comprising a case, a light emitting diode mounted in the case, an electrical power source also mounted in the case, a manually operable switching device for controlling delivery of electrical power from the source to the light emitting diode, and a mounting clip for attachment of the flashlight to a separate article, one of said case and said mounting clip having a recess, and the other of said case and said mounting clip having a projection extending therefrom in a first direction into said recess, said recess having a resilient, deformable side wall, at least one tab on one of said projection and said side wall, and at least one flange on the other of said projection and said sidewall, said at least one tab and said flange being engageable by a snap fit for maintaining engagement of the projection in said recess, the deformability of the side wall allowing the projection and tab to be disengaged from each other by exertion of a bending force to effect relative bending of the case and the mounting clip, whereby the case can be rapidly removed from the mounting clip by manipulation for separation of the case from the mounting clip without disengagement of the mounting clip from said separate article.

2. A miniature flashlight according to claim 1, in which said mounting clip comprises a molded element having a resilient gate, said gate and a part of said element forming a loop openable to receive a key ring, and closable to maintain engagement of the loop with the key ring.

3. A miniature flashlight according to claim 1, in which said mounting clip is a unitary, molded, element having a loop openable to receive a key ring, and closable to maintain engagement of the loop with the key ring.

4. A miniature flashlight according to claim 1, in which said mounting clip has a base, and a loop a part of which is constituted by said base, in which said recess is formed in said base, and in which said projection is a part of said case.

5. A miniature flashlight according to claim 1, in which the case and the mounting clip are sufficiently long, in said first direction, that the bending force required to disengage the projection and tab from each other is less than the pulling force required to disengage the projection and tab from each other by directly pulling the clip away from the case along said first direction.

6. A miniature flashlight comprising a case, a light emitting diode mounted in the case, an electrical power source also mounted in the case, a manually operable switching device for controlling delivery of electrical power from the source to the light emitting diode, and a mounting clip for attachment of the flashlight to a separate article, one of said case and said mounting clip having a recess, and the other of said case and said mounting clip having a projection fitting said recess with a snap fit, whereby the case can be rapidly removed from the mounting clip by manipulation for separation of the case from the mounting clip without disengagement of the mounting clip from said separate article, in which said projection has a main body and a pair of flanges, said flanges being disposed on opposite sides of the main body, and in which said recess has opposed interior sidewalls and retaining tabs formed on said side walls and engageable respectively with said flanges, whereby the projection fits the recess with a snap fit.

7. A miniature flashlight according to claim 6, in which said side walls of the recess are sufficiently resilient to allow the flanges of the projection to move past the retaining tabs when the case is removed from, and connected to, the mounting clip.

8. A miniature flashlight comprising a case, a light emitting diode mounted in the case, an electrical power source also mounted in the case, a manually operable switching device for controlling delivery of electrical power from the source to the light emitting diode, and a mounting clip for attachment of the flashlight to a separate article, one of said case and said mounting clip having a recess, and the other of said case and said mounting clip having a projection extending in a first direction into said recess, and fitting said recess with a snap fit, whereby the case can be rapidly removed from the mounting clip by manipulation for separation of the case from the mounting clip without disengagement of the mounting clip from said separate article, in which said projection has an elongated main body and a pair of flanges, said flanges being disposed on opposite sides of the main body, in which said recess has opposed interior side walls and retaining tabs formed on said side walls and engageable respectively with said flanges whereby the projection fits the recess with a snap fit, and in which said flanges have rounded edges extending in the direction of elongation of said main body of the projection, whereby the projection can be disengaged from the recess by a bending force exerted on the case and said mounting clip about a bend axis extending in the direction of elongation of said projection, said bending force being substantially less than the pulling force required to remove the projection from the recess along said first direction.

* * * * *